US005934598A

United States Patent [19]

Kovacik et al.

[11] Patent Number: 5,934,598

[45] **Date of Patent: *Aug. 10, 1999**

[54] MANUALLY OPERATED CORD STORAGE REEL

[75] Inventors: James D. Kovacik, Brecksville; Paul S. Blanch, Broadview Heights; Stanley E. Grzywna, Elyria, all of Ohio

[73] Assignee: Alert Stamping & Mfg. Co., Inc., Bedford Heights, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/702,143

[22] Filed: Aug. 23, 1996

[51] Int. Cl.[6] ..... B65H 75/30; B65H 75/38; B65H 75/18

[52] U.S. Cl. ..... 242/395; 242/118.4; 242/404.3; 242/405.3; 242/407; 242/587.2; 242/591

[58] Field of Search ..... 242/395, 406, 242/407, 613, 118.4, 587.2, 125.1, 591, 405.3, 395.1, 402, 598.5, 404.3; D8/359; 191/12.2 R

[56] References Cited

U.S. PATENT DOCUMENTS

| | | | |
|---|---|---|---|
| D. 226,165 | 1/1973 | Miller | D8/220 |
| D. 384,878 | 10/1997 | Kovacik | D8/359 |
| 1,807,582 | 6/1931 | Brown | 242/125.1 |
| 2,178,192 | 10/1939 | Tolliver | 200/153 |
| 2,856,470 | 10/1958 | Hyde | 191/12.4 |
| 2,977,427 | 3/1961 | Benjamin | 191/12.2 |
| 3,702,157 | 11/1972 | Thomas | 242/407 X |
| 3,908,277 | 9/1975 | Rutty | 242/395.1 X |
| 4,244,536 | 1/1981 | Harrill | 242/96 |
| 4,338,497 | 7/1982 | Drew | 191/12.4 |
| 4,406,422 | 9/1983 | Philips | 242/118.4 |
| 4,506,698 | 3/1985 | Garcia et al. | 132/355.26 |
| 4,512,361 | 4/1985 | Tisbo et al. | 137/355.27 |
| 4,520,239 | 5/1985 | Schwartz | 242/96 |
| 4,586,676 | 5/1986 | Johnston et al. | 242/157 R |
| 4,653,833 | 3/1987 | Czubernat et al. | 242/96 |
| 4,656,320 | 4/1987 | Maddock | 191/12.4 |
| 4,768,546 | 9/1988 | Brusadin et al. | 242/395 X |
| 4,777,976 | 10/1988 | Johnston et al. | 137/355.27 |
| 5,046,520 | 9/1991 | Sanchez, Jr. et al. | 137/355.27 |
| 5,056,553 | 10/1991 | Whitehead et al. | 242/395 X |
| 5,308,011 | 5/1994 | Roman | 242/395 X |
| 5,636,808 | 6/1997 | Colin | 242/406 X |

OTHER PUBLICATIONS

Sears, Roebuck and Company, *Craftsman 71–69621 Wall Mount Hose Reel Owner's Manual*, 1991, 4 pages, U.S.A.

Alert Stamping & Mfg. Co., Inc., *Alert catalog*, Mar. 1991, 5th page, U.S.A.

*Primary Examiner*—John Q. Nguyen

*Attorney, Agent, or Firm*—MacMillan, Sobanski & Todd, LLC

[57] ABSTRACT

An apparatus (11) for storing a cord includes a pair of side panels (12, 13) each having a plurality of retainer cavities (29, 30, 31), a bearing aperture (26) and a pair of mounting bosses (64) formed thereon, a plurality of spacer bars (14, 15, 16) having opposite ends (33, 35, 37) inserted into corresponding ones of the retainer cavities for maintaining the side panels in spaced apart relationship and threaded fasteners (50) attaching the side panels to the spacer bars. A spool (17) for storing a cord has opposite ends (41, 44) rotatably retained in the bearing apertures (26) and slots (68, 69, 70) with cut outs (68a, 69a, 70a) for retaining an end of the cord. A winding handle (18) is attached to the spool (17) by legs (55) engaging retainers (52) on the spool ends (41, 44). Mounting brackets (19) are provided for receiving the mounting bosses (64) and releasably retaining the side panels (12, 13) on a mounting surface.

6 Claims, 4 Drawing Sheets

62
18
60
50
53
26
63
22a
49
64
11
12
20
41
55
27
37
23
51
31
52
56
28b
28e
6
42
33
30
22
28g
47
5
16
46
36
40
38
17
68
68a
14
32
29
28c
59
58
57
28
13
41

MANUALLY OPERATED CORD STORAGE REEL

BACKGROUND OF THE INVENTION

The present invention relates generally to an apparatus for storing cords and, in particular, to a portable manually operated cord storage reel.

Cords, such as lines, ropes and electrical extension cords, and cord-like devices, such as water and air hoses, can be difficult to store, transport and keep from tangling. For example, many times it is desirous to operate electrically powered tools and appliances at locations remote from an electrical outlet. In those instances, an electrical extension cord can be utilized to deliver the electrical power to the remote location. As the required length of the electrical extension cord increases, so do problems involving keeping the cord from becoming tangled, storing the cord and carrying the cord from location to location.

One solution to these problems is shown in the U.S. Pat. No. 2,856,470 wherein an electrical extension cord is stored on a reel rotatably mounted inside a portable enclosed housing. A handle arm having a rotatable knob is provided for rotating the reel to wind the cord into the housing. One end of the cord is connected to a pair of electrical receptacles mounted in an exposed end plate of the reel. The other end of the cord extends through an opening in the housing and terminates in an electrical plug which can be engaged with an electrical receptacle at a source of electrical power. A carrying handle is attached to an outer surface of the housing.

There is shown in the U.S. Pat. No. 2,977,427 a reel for a lawn mower electrical cord which reel is rotatably mounted on a support arm which can be inserted into a socket fixed in the earth or secured to any non-movable surface. A handle is attached to the reel for rotating the reel to wind the cord.

The U.S. Pat. No. 4,244,536 shows an extension cord reel rotatably mounted in a portable housing having one side open to expose a side of the reel. A handle is provided on the exposed side of the reel for winding the cord. The reel is formed of two identical spool sections. A carrying handle is attached to an outer surface of the housing.

The U.S. Pat. No. 4,338,497 shows a portable extension cord reel set including a reel formed of two symmetrical halves, an enclosed housing formed of two symmetrical halves which in the reel is rotatable and an extension cord having a female outlet molded on to one of its ends with the outlet being trapped in an operative position between the two halves of the reel. Both sides of the reel are exposed with the outlet on one side and a handle for winding the cord on the other side. A carrying handle is attached to an outer surface of the housing.

The U.S. Pat. No. 4,520,239 shows a portable electrical cord reel and storage system including an enclosure having a carrying handle and rotatably mounting a reel for winding an electrical extension cord with a winding handle attached to the reel.

The U.S. Pat. No. 4,653,833 shows a retractable booster cable device including a portable container which rotatably supports a spool having a knob on an exposed side for winding the cables on the spool. A carrying handle is attached to an outer surface of the container.

The U.S. Pat. No. 4,656,320 shows a portable electrical cord reel including a housing having a carrying handle and being open at one side to expose a rotatably mounted hub with a winding handle attached thereto.

While many of the prior art electrical cord storage devices are portable, they do not provide for mounting on a surface for storage or use. Furthermore, the housings tend to add weight and obstruct a view of how well the cord is wound on the reel.

SUMMARY OF THE INVENTION

The present invention concerns a portable apparatus for storing a cord such as an electrical extension cord. The apparatus includes a pair of side panels each having a plurality of retainer cavities formed therein, a bearing aperture formed therethrough and at least one mounting boss formed thereon and a plurality of spacer bars each having opposite ends inserted into corresponding ones of the retainer cavities for maintaining the side panels in spaced apart relationship, one of the spacer bars forming a carrying handle. A first plurality of fastener means extend through attachment apertures formed in the sides panels and engage attachment apertures formed in the ends of the spacer bars for retaining the spacer bar ends in the cavities. A spool for storing an electrical extension cord has a pair of spool sections with opposite ends rotatably retained in the bearing apertures and a retainer means attached to the spool section ends. One of the spool sections has a plurality of flange segments extending radially therefrom and the other spool section also has a plurality of flange segments extending radially therefrom, the flange segments retaining an electrical extension cord on said spool. A second plurality of fastener means extend through first apertures formed in the one spool section and engage second apertures formed in the other spool section to couple the spool sections together. A winding handle is attached to the spool by the retainer means for rotating the spool in the bearing apertures. A mounting means adapted to be attached to a generally vertical mounting surface is provided for receiving the mounting bosses and releasably retaining the side panels on the mounting surface.

It is an object of the present invention to provide for releasable mounting of a portable electrical extension cord reel on a generally vertical mounting surface.

It is a further object of the present invention to reduce the weight of portable electrical extension cord reels.

It is another object of the present invention to expose the electrical extension cord wound on a reel to view.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
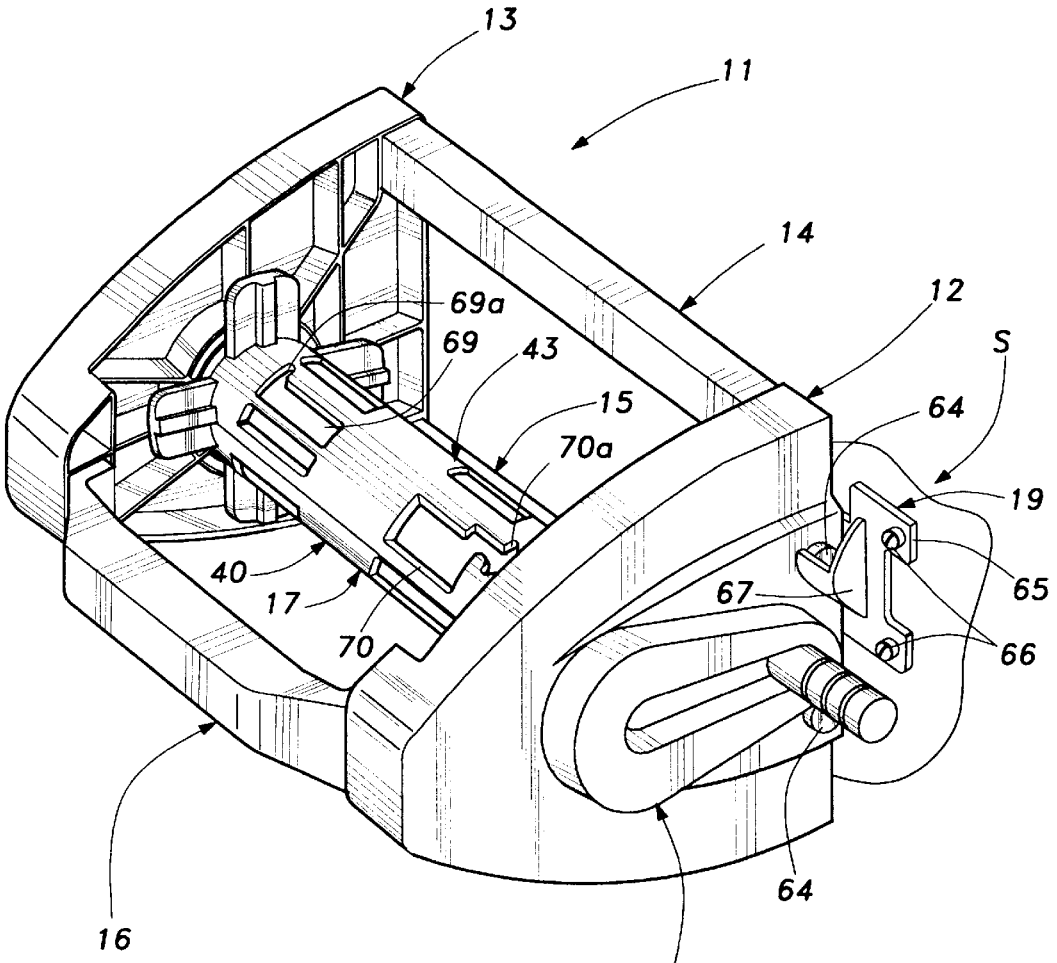
FIG. 1 is a perspective view of a manually operated electrical cord reel apparatus in accordance with the present invention.
Figure 2:
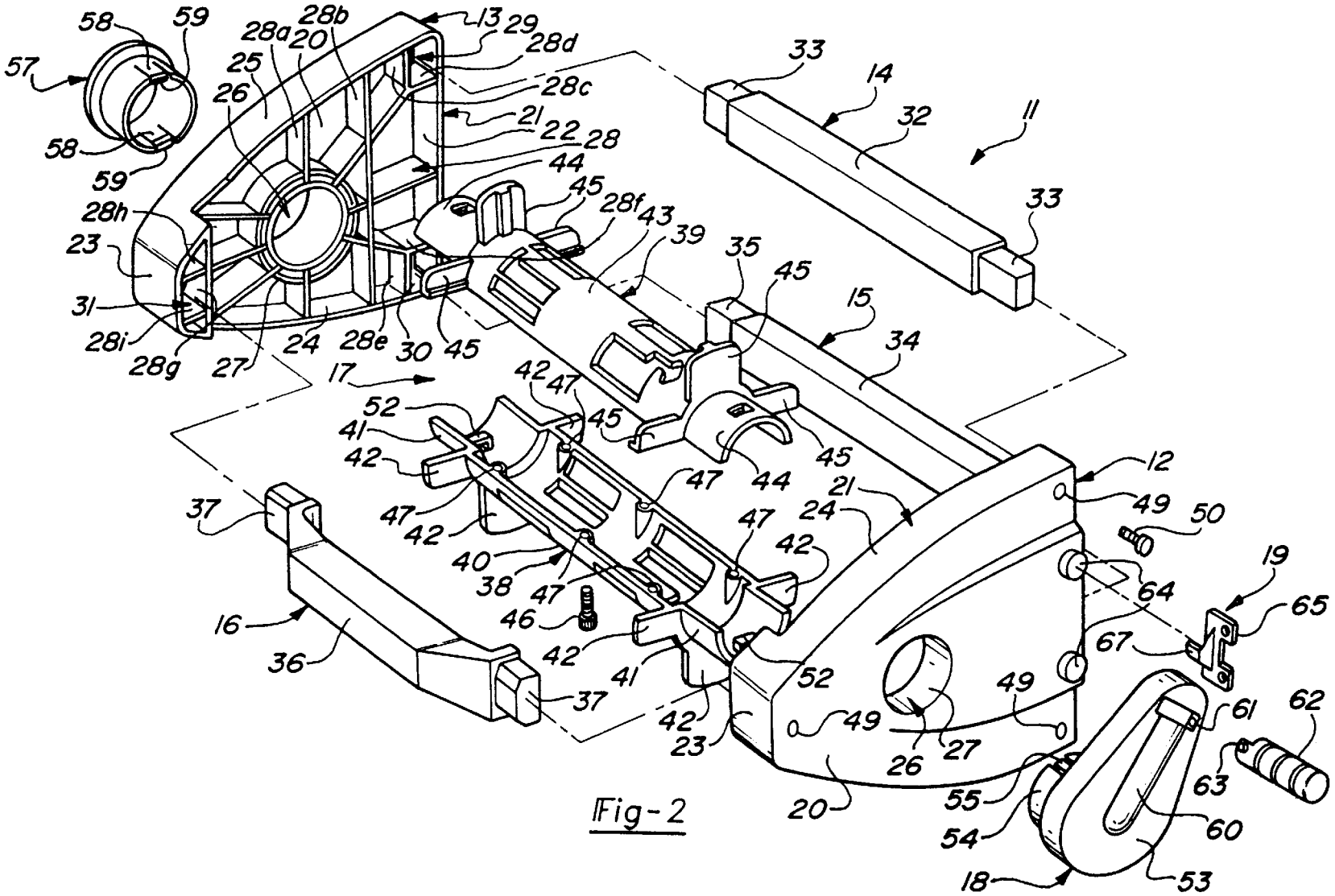
FIG. 2 is an exploded perspective view of the apparatus shown in the FIG. 1.

There is shown in the FIG. 1 and the FIG. 2 a manually operated cord storage reel apparatus 11 in accordance with the present invention. A pair of side panels 12 and 13 are maintained in spaced apart relationship by a plurality of spacer bars 14, 15 and 16. The spacer bar 16 also functions as a carrying handle for the apparatus 11. A reel or spool 17 is rotatably retained at opposite ends thereof in the side panels 12 and 13. A winding handle 18 can be attached to either end of the spool 17 for rotating the spool about its longitudinal axis to wind up a cord (not shown) such as an electrical extension cord. A mounting means 19 is provided for releasably retaining the cord storage reel apparatus 11 on a mounting surface S such as a wall of a building.

Figure 3:
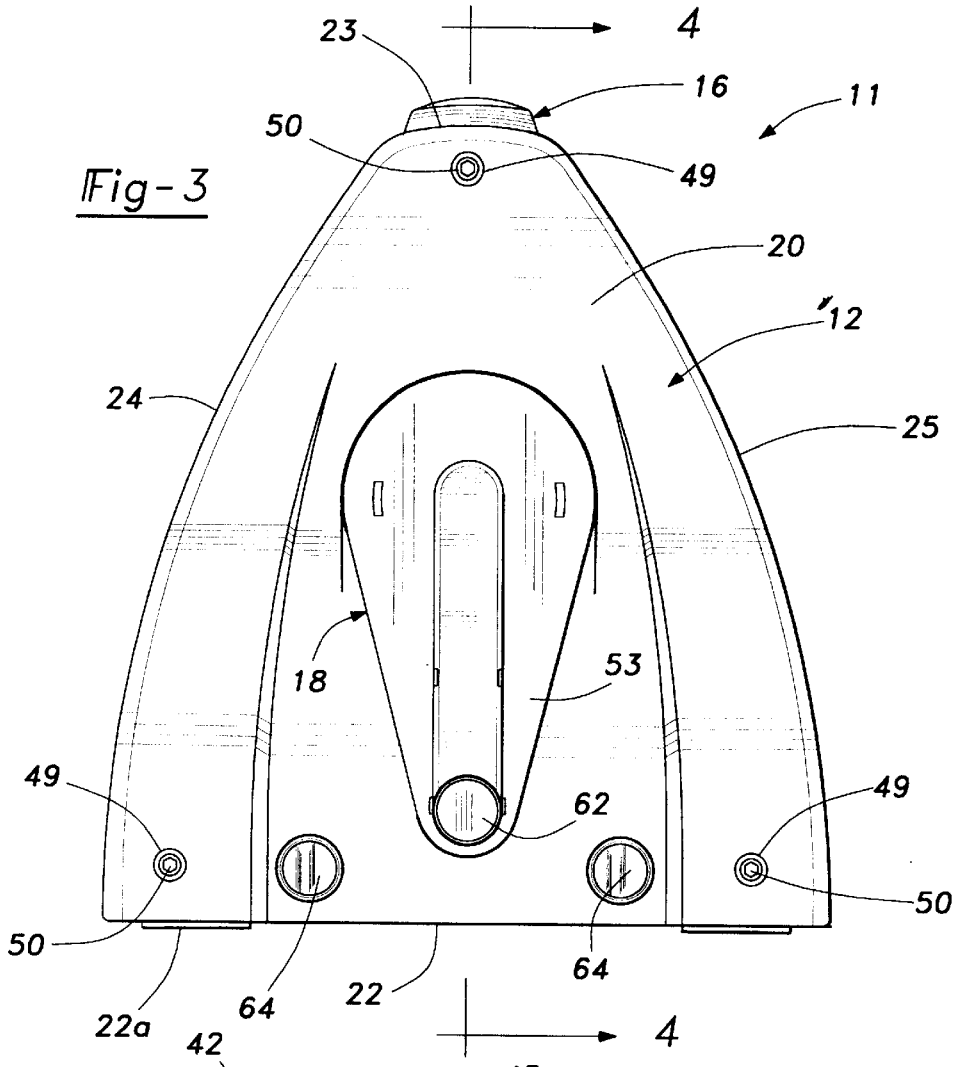
FIG. 3 is a right side elevation view of the apparatus shown in the FIG. 1.
Figure 4:
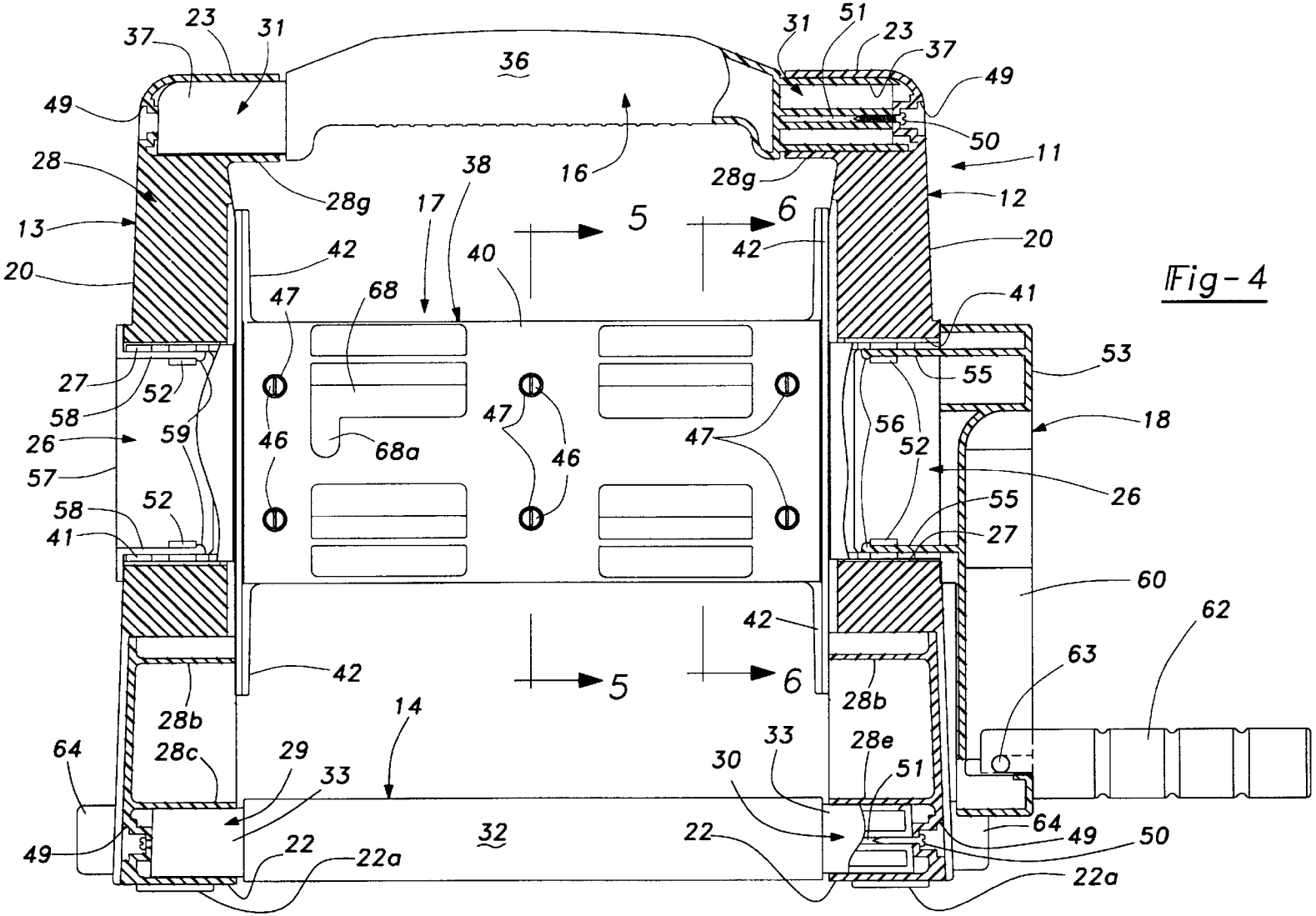
FIG. 4 is a cross-sectional view of the apparatus taken along the line 4—4 the FIG. 3.

The side panels 12 and 13 are formed with an identical construction such that they are interchangeable as shown in the FIG. 2 and the FIG. 4. The side panels 12 and 13 include a generally planar end wall 20 in the shape of a truncated triangle or trapezoid (see the FIG. 3). Extending from a plane of the end wall 20 about a periphery thereof is flange 21 formed from a bottom portion 22, a generally parallel top portion 23 and side portions 24 and 25 which are connected between corresponding ends of the bottom portion 22 and the top portion 23. A pair of pads or feet 22*a* (see the FIG. 3 and the FIG. 4) upon which the apparatus 11 can rest are formed on an external surface of the bottom portion 22. A bearing aperture 26 is formed in each of the end walls 20 to retain the ends of the spool 17 as described below. A generally cylindrical bearing wall 27 surrounds the aperture 26 and extends from the plane of the end wall 20 in the same direction as the flange 21 to form a bearing surface.

A plurality of ribs 28 are formed on the side wall 20 and extend between portions of the flange 21 and between the flange and the bearing wall 27 to strengthen the side panels 12 and 13. For example, a rib 28*a* extends between the side portion 25 and the bearing wall 27 and a rib 28*b* extends between the side portions 24 and 25. The ribs 28 also form a retainer cavity 29 at the junction of the bottom portion 22 and the side portion 25 for retaining an end of the bar 14. A rib 28*c* extends from the side portion 25 and joins a rib 28*d* extending from the bottom portion 22 to enclose the cavity 29. In a similar manner, a rib 28*e* extends from the side portion 24 and joins a rib 28*f* extending from the bottom portion 22 to enclose a retainer cavity 30 for retaining an end of the bar 15. The flange 21, the bearing wall 27 and the ribs 28 are approximately the same height. However, the top portion 23 and adjacent sections of the side portions 24 and 25 of the flange 21 are taller to form a deeper retainer cavity 31 to retain an end of the bar 16. A rib 28*g* extends between the side portions 24 and 25 and a pair of ribs 28*h* and 28*i* extend between the top portion 23 and the rib 28*g* to define the retainer cavity 31.

The spacer bar 14 has a central portion 32 extending between reduced cross section end portions 33. The retainer cavity 29 in the side panel 13 and the retainer cavity 30 in the side panel 12 are shaped and sized to snugly receive the reduced cross section end portions 33 of the bar 14. In a similar manner, the spacer bar 15 has a central portion 34 extending between reduced cross section end portions 35 which end portions are received in the retainer cavity 30 in the side panel 13 and the retainer cavity 29 in the side panel 12. The spacer bar 16 has a generally U-shaped central portion 36 suitable for grasping by a human hand to provide a carrying handle for the assembly 11. At opposite ends of the central portion 36 are formed reduced cross section end portions 37. The retainer cavities 31 are shaped and sized to snugly receive the reduced cross section end portions 37 of the bar 16.

Figure 5:
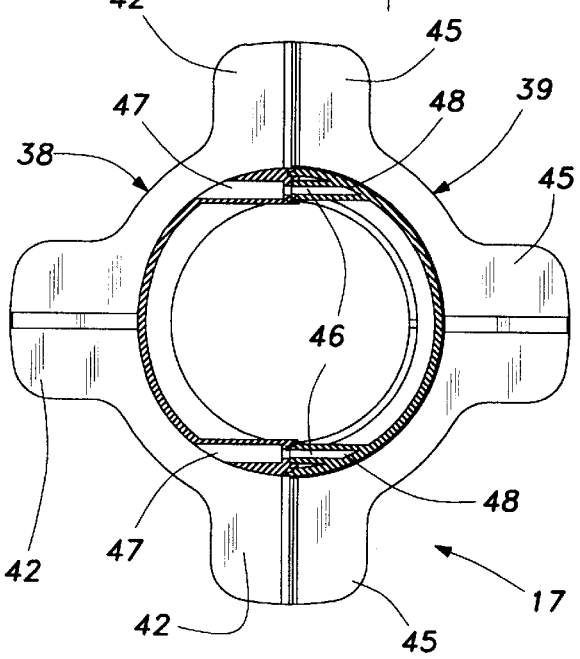
FIG. 5 is a cross-sectional view of the apparatus taken along the line 5—5 in the FIG. 4.

The spool 17 is tubular and is formed of a pair of half cylindrical spool sections 38 and 39 which are similar. The first spool section 38 includes a central portion 40 extending between a pair of reduced diameter end portions 41. Extending radially outwardly from the junction of the central portion 40 with each of the end portions 41 are three flange segments 42 spaced apart approximately 90°. The second spool section 39 is similar to the first spool section 38 having a central portion 43 extending between reduced diameter end portions 44 with three flange segments 45 extending radially outwardly therefrom approximately 90° apart. The spool sections 38 and 39 can be connected together by any suitable means such as a plurality of threaded fasteners 46 extending through a corresponding plurality of first apertures 47 formed in the central portion 40 and threadably engaging a corresponding plurality of blind second apertures 48 (see the FIG. 5) formed in the central portion 43 of the spool section 39. The flange segments 42 and 45 guide a cord (not shown) as it is wound on the outer surface of the central portions 40 and 43 of the spool 17.

As shown in the FIG. 2, the FIG. 3 and the FIG. 4, the side panels 12 and 13 are fastened to the spacer bars 14, 15 and 16. A plurality of first attachment apertures 49 are formed in the end wall 20, one aperture at each of the cavities 29, 30 and 31. A plurality of threaded fasteners 50 extend through the first attachment apertures 49 and threadably engage corresponding blind second attachment apertures 51 formed in the ends 33, 35 and 37.

Figure 6:
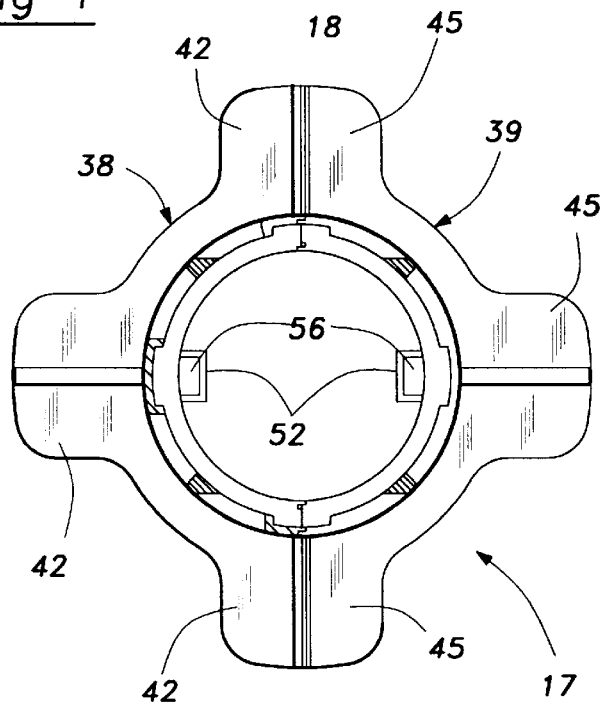
FIG. 6 is a cross-sectional view of the apparatus taken along the line 6—6 in the FIG. 4.

As shown in the FIG. 2, the FIG. 4 and the FIG. 6, the end portions 41 and 44 of the spool sections 38 and 39 respectively each have legs of a generally U-shaped retainer means 52 attached to an inwardly facing surface to form a retaining aperture. The winding handle 18 has a generally planar body 53 with a generally tubular projection 54 formed at a wider end thereof. A wall of the projection 54 is slotted to form a pair of diametrically opposed attachment means 55 each in the form of a leg having a tab 56 formed at a free end thereof. When the abutting end portions 41 and 44 at one end of the assembled spool 17 are inserted into one of the bearing apertures 26, the projection 54 on the winding handle can be inserted inside the end portions at the one end of the spool and the free ends of the attachment means legs 55 will extend through the retaining apertures formed by the retainer means 52 such that the tabs 56 resist detachment of the winding handle from the spool.

In a similar manner, a generally tubular plug 57 has a wall which is slotted to form a pair of diametrically opposed attachment means 58 in the form of legs each having a tab 59 formed at a free end thereof. When the abutting end portions 41 and 44 at the other end of the assembled spool 17 are inserted into the other bearing aperture 26, the plug 57 can be inserted inside the end portions and the free ends of the legs 58 will extend through the retaining apertures formed by the retainer means 52 such that the tabs 59 resist detachment of the plug from the spool. The end portions 41 and 44, the projection 54 and the plug 57, the attachment means 55 and 58, and the tabs 56 and 59 are sized such that the winding handle 18 and the plug are interchangeable and can be retained in either end of the spool 17.

As shown in the FIG. 2 and the FIG. 4, the body 53 of the winding handle 18 has a longitudinally extending cavity 60 formed therein on the opposite surface from the projection 54. At the end of the cavity 60 opposite the projection 54, the cavity is widened and a pair of depressions 61 formed in facing walls thereof. A generally cylindrical knob 62 has a pair of diametrically opposed pins 63 formed at one end thereof. When the one end of the knob 62 is inserted into the widened end of the cavity 60, the pins 63 snap into corresponding ones of the depressions 61 to retain the knob on the winding arm 18.

As shown in the FIG. 1 and the FIG. 2, a pair of outwardly extending mounting bosses 64 are formed on the exterior surface of the end walls 20 near the bottom portion 22 thereof. Each of the mounting bosses 64 is designed to cooperate with a mounting bracket 65 of the mounting means 19. The mounting bracket 65 has a pair of apertures formed therein for receiving threaded fasteners 66 which can be attached to the mounting surface S. The mounting bracket 65 also has a cup-shaped receiver 67 formed thereon into which one of the mounting bosses 64 can be inserted. Thus, the cord storage reel apparatus 11 is removably supported from the surface S by the mounting means 19 and easily can be reversed from the position shown in the FIG. 1.

The central portion 40 of the first spool section 38 and the central portion 43 of the second spool section 39 each have a plurality of generally rectangular slots formed therein. As shown in the FIG. 4, the central portion 40 has a first slot 68 formed therein adjacent one of the flange segments 42. In one corner of the slot 68 there is formed a small cut out 68*a* which extends circumferentially in the wall of the central portion 40. As shown in the FIG. 1 and the FIG. 2, the central portion 43 has a second slot 69 formed therein adjacent one of the flange segments 45. In one corner of the slot 69 there is formed a small cut out 69*a* which extends circumferentially in the wall of the central portion 43. The cut outs 68*a* and 69*a* extend in opposite directions and function as attachment means for the end of a cord to be wound on the spool 17. For example, it may be desirable to releasably attach one end of a cord, such as a rope (not shown), to the spool 17. A knot can be tied in the end of the cord, the knot inserted into the interior of the spool 17 through the slot 68 or the slot 69 and the cord pushed into the corresponding cut out 68*a* or 69*a* to releasably retain the cord on the spool during winding and unwinding.

Also formed in the central portion 43 of the second spool section 39, at the opposite end from the slot 69, is a generally rectangular third slot 70 as shown in the FIG. 1 and the FIG. 2. The slot 70 formed adjacent one of the flange segments 45 and in one corner of the slot there is formed an arrowhead shaped cut out 70*a* which extends longitudinally in the wall of the central portion 43. The cut out 70*a* functions as an attachment means for the end of a cord to be wound on the spool 17. For example, it may be desirable to releasably attach one end of an electrical extension cord to the spool 17. One end of the extension cord, such as the electrical plug end, can be inserted into the interior of the spool 17 through the slot 70 and can exit the cord storage reel apparatus 11 through the open center of the tubular plug 57. The extension cord is pushed into the cut out 70*a* to releasably retain the extension cord on the spool 17.

In summary, the apparatus 11 for storing a cord includes the pair of side panels 12, 13, each having at least one retainer cavity 29, 30, 31 formed therein and the bearing aperture 26 formed therethrough, and at least one spacer bar 14, 15, 16 having opposite end portions 33, 35, 37 retained in the retainer cavities for maintaining the side panels in spaced apart relationship. The tubular spool 17 for storing a cord has opposite end portions 41, 44 rotatably retained in the bearing apertures 26 and the retainer means 52 attached to each of the spool end portions. The winding handle 18 for rotating the spool 17 in the bearing apertures 26 has the attachment means 55 cooperating with the retainer means 52 for releasably attaching the winding handle to the spool at a selected one of the spool section end portions 41, 44. Each of the side panels 12, 13 has the generally planar end wall 20, the flange 21 extending from a periphery of the end wall and a plurality of the ribs 28 extending from the end wall and cooperating with the flange to form the retainer cavities 29, 30, 31. The side panels 12, 13 each include the bearing wall 27 formed thereon extending about the bearing aperture 26.

The spacer bar 16 includes the central portion 36 forming a carrying handle. The side panels 12, 13 each have at least one mounting boss 64 formed thereon and the apparatus 11 includes the mounting means 19 adapted to be attached to a mounting surface for receiving the mounting bosses and releasably retaining the side panels on the mounting surface. The spool 17 has the first spool section 38 with a first one of the spool end portions 41 formed at each end thereof and one of the retainer means 52 attached to each of the first spool section ends and the second spool section 39 with a second one of the spool end portions 44 formed at each end thereof and one of the retainer means attached to each of the second spool section ends. The first spool section 38 has at least the first aperture 47 formed therein and the second spool section 39 has the second aperture 48 formed therein and the fastener means 46 extends through the first aperture and engages the second aperture to attach the first and second spool sections together. The spool 17 also has the plurality of flange segments 42, 45 extending radially therefrom for retaining a cord on the spool.

The winding handle attachment means 55 includes at least one leg with the tab 56 for engaging the retainer means 52. The tubular plug 57 is provided having the attachment means 58 cooperating with the retainer means 52 for releasably attaching the plug to the spool 17 at one of the spool end portions 41, 44 opposite the winding handle 18. The plug attachment means 58 includes at least one leg with the tab 59 for engaging the retainer means 52.

The side panels 12, 13 each have at least one foot 22*a* formed thereon. The side panels 12, 13 also have first attachment apertures 49 formed therein and the spacer bars 14, 15, 16 have second attachment apertures 51 formed in the opposite end portions 33, 35, 37 and the fastener means 50 extend through the first attachment apertures and engage the second attachment apertures for attaching the side panels to the spacer bars. The winding handle 18 has the cavity 60 formed therein with at least one depression 61 formed in a wall of the cavity and the knob 62 has at least one pin 63 formed at one end thereof, the pin cooperating with the depression to retain the knob in the cavity.

The spool 17 has at least one slot 68, 69, 70 formed therein whereby the end of a cord can be inserted into the slot and can extend into an interior of the spool for retaining the end of the cord. The slots 68, 69, 70 include the cut outs 68*a*, 69*a*, 70*a* respectively for retaining an end of the cord and the end of the cord can exit the spool 17 through the center of the plug 57.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A manually operated portable cord storage reel apparatus for windably storing a cord and for transporting the cord by hand carrying comprising:

a pair of side panels each having a plurality of retainer cavities formed therein, an end wall having a bearing aperture formed therethrough, and at least one mounting boss formed on an exterior surface of said end wall adjacent a bottom portion of said side panel;

a plurality of spacer bars extending between and attached to said sides panels, each said spacer bar having opposite end portions respectively retained in associated ones of said retainer cavities for maintaining said side panels in a fixed spaced apart relationship;

a generally tubular spool for storing a cord, said spool having opposite end portions respectively rotatably retained in said bearing apertures and a retainer attached to each of said spool end portions;

a winding handle for rotating said spool about a longitudinal axis of said spool in said bearing apertures, said winding handle having an attachment means releasably engaged with one of said retainers for releasably attaching said winding handle to said spool at a selected one of said spool end portions; and a mounting means adapted to be attached to a generally vertical mounting surface and having recesses for receiving said mounting bosses and releasably retaining said bottom portions of said side panels on the mounting surface, and wherein said winding handle is accessible for rotating said spool when the portable cord storage reel apparatus is removably retained by said mounting means in a first position with said bottom portions resting on the generally vertical mounting surface and said longitudinal axis of said spool extending in a generally horizontal direction and when said bottom portions are resting on a generally horizontal surface in a second position, the portable cord storage reel apparatus being capable of being hand carried between the first and second positions.

2. The portable cord storage reel apparatus according to claim 1 wherein each of said side panels has a pair of feet formed on said bottom portion for resting on the vertical mounting surface in the first position and for supporting the apparatus on the generally horizontal surface in the second position.

3. The apparatus according to claim 1 wherein one of said spacer bars includes a generally U-shaped central portion forming a carrying handle.

4. The apparatus according to claim 1 wherein said spool has a plurality of spaced apart flange segments extending radially therefrom adjacent said end portions for retaining a cord on said spool.

5. The apparatus according to claim 1 wherein said spool has a slot formed therein including an arrowhead shaped cut out for releasably retaining the cord to be wound on said spool.

6. A manually operated portable cord storage reel apparatus for windably storing a cord and for transporting the cord by hand carrying comprising:

a pair of side panels each including a generally planar end wall in the shape of a trapezoid with a flange extending inwardly from a plane of said end wall about a periphery thereof, a plurality of ribs extending inwardly from the plane of said end wall and cooperating with said flange to form a plurality of retainer cavities, a bearing aperture formed through said end wall, at least one mounting boss extending outwardly from the plane of said end wall adjacent a bottom portion of said flange and a pair of feet formed on said bottom portion for resting the apparatus on a generally horizontal surface;

a plurality of spacer bars each having opposite end portions inserted into associated ones of said retainer cavities, said spacer bars being attached to said side panels for maintaining said side panels in a spaced apart relationship, one of said spacer bars adjacent a top portion of said flanges forming a carrying handle;

a spool for storing a cord formed of a pair of half cylindrical spool sections, said spool having opposite end portions respectively rotatably retained in said bearing apertures, a retainer attached to each of said spool end portions, a plurality of spaced flange segments extending radially from each of said spool end portions for retaining a cord wound on said spool, and a pair of axially extending slots formed in said spool having cut outs extending from said slots circumferentially of said spool in opposite directions for retaining the cord to be stored on said spool;

a winding handle for rotating said spool about a longitudinal axis of said spool in said bearing apertures, said winding handle being releasably engaged with one of said retainers at a selected one of said spool end portions;

a generally tubular plug releasably engaged with one of said retainers at one of said spool end portions opposite said winding handle; and a mounting means adapted to be attached to a generally vertical mounting surface and having recesses for receiving said mounting bosses and releasably retaining said bottom portions of said side panels on the mounting surface, and wherein said winding handle is accessible for rotating said spool when the portable cord storage reel apparatus is removably retained by said mounting means in a first position with said bottom portions resting on the generally vertical mounting surface and said longitudinal axis of said spool extending in a generally horizontal direction and when said bottom portions are resting on a generally horizontal surface in a second position, the portable cord storage reel apparatus being capable of being hand carried between the first and second positions.

* * * * *